US008002651B2

(12) United States Patent
Babolat

(10) Patent No.: US 8,002,651 B2
(45) Date of Patent: Aug. 23, 2011

(54) TENNIS RACQUET FRAME, ITS METHOD OF MANUFACTURE, AND RACQUET COMPRISING SUCH A FRAME

(75) Inventor: Eric Babolat, Lyons (FR)

(73) Assignee: Babolat VS, Lyons (FR)

( * ) Notice: Subject to any disclaimer, the term of this patent is extended or adjusted under 35 U.S.C. 154(b) by 458 days.

(21) Appl. No.: 12/153,715

(22) Filed: May 22, 2008

(65) Prior Publication Data

US 2009/0082143 A1 Mar. 26, 2009

(30) Foreign Application Priority Data

May 24, 2007 (FR) ..... 07 03678

(51) Int. Cl.
*A63B 49/02* (2006.01)
*A63B 49/06* (2006.01)

(52) U.S. Cl. ..... 473/546; 473/537; 473/536; 473/524

(58) Field of Classification Search ..... 473/524, 473/525–537, 546, 547; D21/729, 730
See application file for complete search history.

(56) References Cited

U.S. PATENT DOCUMENTS

| | | | | | |
|---|---|---|---|---|---|
| 881,266 | A * | 3/1908 | Thompson et al. | ..... | 473/524 |
| 1,942,479 | A * | 1/1934 | Kleinman | ..... | 473/546 |
| 2,224,567 | A | 12/1940 | Reach | | |
| 4,139,194 | A | 2/1979 | Fischer | | |
| 4,394,014 | A * | 7/1983 | Balaban | ..... | 473/546 |
| 5,060,944 | A | 10/1991 | Janes | | |
| D330,925 | S * | 11/1992 | Janes | ..... | D21/730 |
| 7,371,198 | B2 * | 5/2008 | Pai | ..... | 473/546 |
| D596,682 | S * | 7/2009 | Severa et al. | ..... | D21/730 |
| D622,793 | S * | 8/2010 | Severa et al. | ..... | D21/730 |
| 2007/0123377 | A1 | 5/2007 | Gazzara | | |
| 2008/0039244 | A1 * | 2/2008 | Pai | ..... | 473/535 |
| 2008/0254921 | A1 * | 10/2008 | Pai | ..... | 473/524 |
| 2008/0274843 | A1 | 11/2008 | Gazzara | | |
| 2009/0082143 | A1 * | 3/2009 | Babolat | ..... | 473/524 |

FOREIGN PATENT DOCUMENTS

| | | | |
|---|---|---|---|
| DE | 35 21 621 | A1 | 1/1986 |
| FR | 2 354 110 | A | 1/1978 |
| JP | 2004105531 | A * | 4/2004 |

* cited by examiner

*Primary Examiner* — Raleigh W. Chiu
(74) *Attorney, Agent, or Firm* — Dowell & Dowell, PC

(57) ABSTRACT

A tennis racquet frame including a handle, a rim and arms connecting the handle and the rim and wherein each arm includes two fingers extending one above and one below the rim when the racquet frame is laid flat on a support surface.

17 Claims, 3 Drawing Sheets

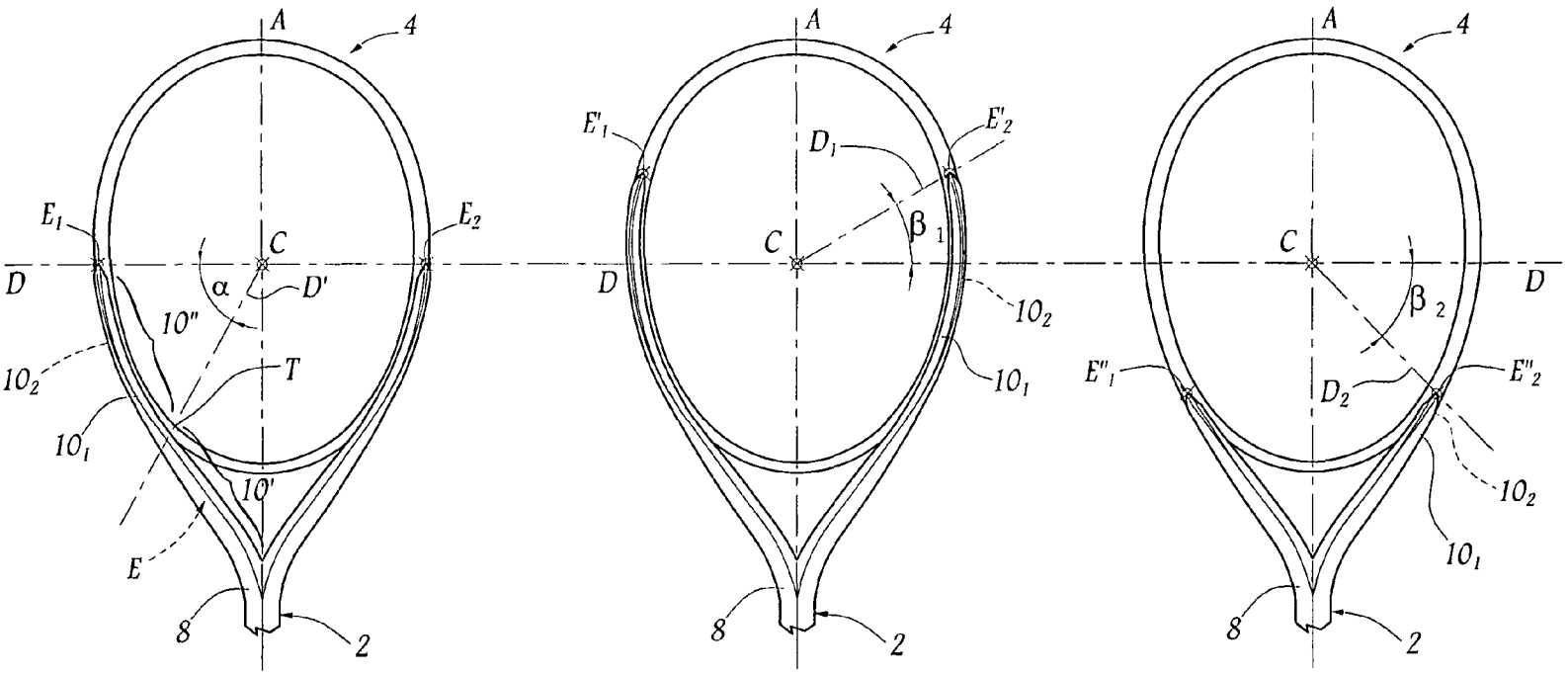
Fig.2
Fig.2A
Fig.2B
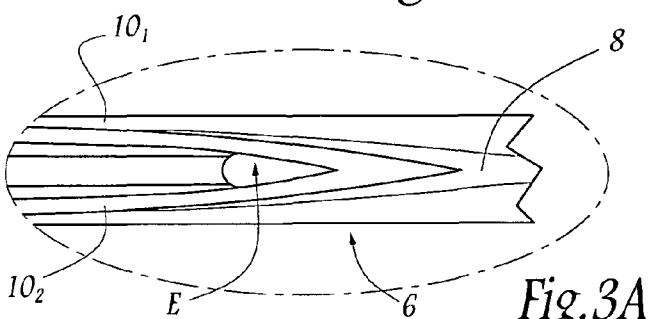
Fig.3A
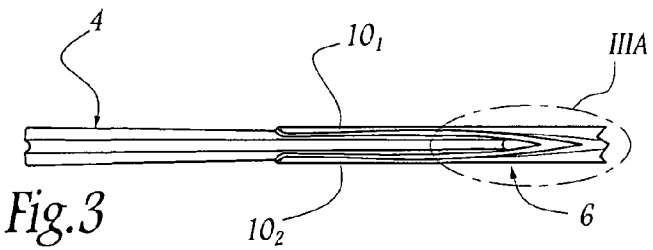
Fig.3

TENNIS RACQUET FRAME, ITS METHOD OF MANUFACTURE, AND RACQUET COMPRISING SUCH A FRAME

BACKGROUND OF THE INVENTION

1. Field of the Invention

This invention relates to a tennis racquet frame, its method of manufacture, and a racquet comprising such a frame.

2. Description of the Related Art

In the conventional way, a tennis racquet frame comprises a handle, a rim, and two diverging arms connecting this handle to this rim. In the case of a conventional composite racquet, a "preform" combining the handle, arms and most of the rim is made first. Then a connecting region, also known as the "yoke", is made, forming the bridge of the racquet, and the whole assembly is placed in a mould.

SUMMARY OF THE INVENTION

Against this background, it is an object of the invention to provide a tennis racquet frame that offers an alternative to the known solutions. It is particularly intended to provide such a frame in which the structure is more modular than is the structure of prior art racquets.

For this purpose the invention relates to a tennis racquet frame comprising a handle, a rim and arms connecting this handle and this rim, said frame being characterized in that each arm comprises two fingers extending one above and one below the rim when the racquet frame is laid flat.

Other features are as follows:

- each arm comprises a base continuing on from the handle, from which there extend the two fingers;
- the two fingers comprise a free region in which they define a void, and a region of mechanical connection to the rim;
- the free end of the mechanical connection region of each finger defines a straight line forming, with a central transverse straight line of the rim, an angle of between −60° and +30°;
- the mechanical connection region occupies an angular sector of between 10 and 90°, preferably between 30 and 60°;
- the two fingers of each arm are moulded integrally with the rim;
- the two fingers and the rim are formed by a single tubular member;
- the two fingers are formed from a first tubular member, while the rim is made from a second tubular member;
- the rim is fixed permanently to the two fingers of each arm, particularly by welding or adhesive bonding;
- the two fingers of each arm are fixed removably to the rim, particularly by snap-fastening or screw-fastening;
- this frame is made in one material, particularly a carbon-based composite material;
- the handle and the two arms are made of one material, while the rim is made of another material.

The invention also relates to a method of manufacturing the above racquet frame, in which a preform combining the handle and the two arms on the one hand, and a preform of the rim on the other, are produced, these two performs are then both placed in the same mould, and the final racquet frame is formed.

The invention also relates to a method of manufacturing the above racquet frame, in which a first element formed of the handle and of the arms on the one hand, and a second element forming the rim on the other, are produced, and these two elements are fixed to each other.

Lastly, the invention relates to a tennis racquet comprising a frame as above.

BRIEF DESCRIPTION OF THE DRAWINGS

The invention will be described below with reference to the accompanying drawings, which are given purely by way of non-restrictive examples. In the drawings:

FIGS. 1 to 3 are perspective, front and side views, respectively, of a tennis racquet frame in a first variant of the invention;

FIGS. 2A and 2B are front views, similar to FIG. 2, showing two alternative embodiments of the racquet frame of the invention;

FIG. 3A is an enlarged view from FIG. 3;

DESCRIPTION OF THE PREFERRED EMBODIMENTS

Figure 1:
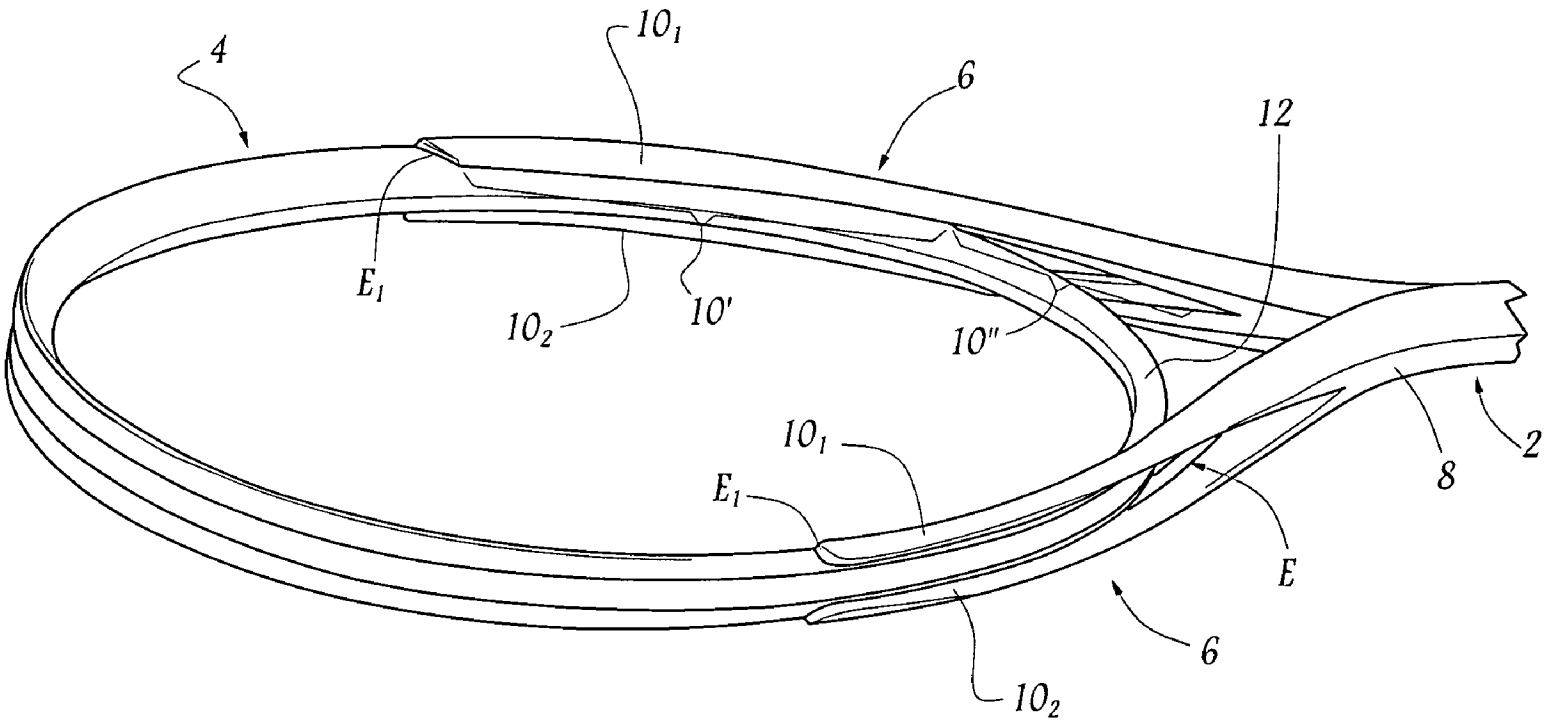

The tennis racquet frame shown in FIGS. 1 to 3 comprises in the usual way a handle 2, shown partially, and a rim 4, in which strings (not shown) may be strung. There are also two connecting arms 6 which diverge, with reference to the front view, FIG. 2, from the handle 2 to the rim 4. As can be seen in FIGS. 3 and 3A, which are side views, each arm 6 is roughly Y-shaped in the sense that it has a base 8 continuing on from the handle 2, and two fingers $\mathbf{10}_1$ and $\mathbf{10}_2$ that extend between this base 8 and the rim 4.

These fingers $\mathbf{10}_1$ and $\mathbf{10}_2$ are separated from each other and roughly parallel. At the end nearest the base 8, these fingers initially define a void marked E. The fingers then pass over the rim 4, one above and one below it, when the racquet is laid flat.

To facilitate the reading of the description, certain geometrical definitions of the racquet frame will now be given with reference to FIGS. 2, 2A and 2B. In these figures A is the main axis of the racquet, corresponding to that of the handle and therefore vertical when the racquet is stood on the end of this handle. D is the central transverse straight line perpendicular to the above-mentioned axis A: it passes through the widest part of the rim 4. Finally, C is the centre of the racquet, corresponding to the intersection between this main axis A and this central transverse straight line D.

FIGS. 1 and 2 show the base 8, a first region 10' in which the fingers define the abovementioned void E, and a mechanical connection region 10" in which these fingers are attached to the rim. In the example illustrated, this connection region 10" extends approximately as far as a central region of the rim, defined by the abovementioned straight line D. In other words the free ends $E_1$ and $E_2$ of these fingers lie on this straight line D.

However, in a variant, this mechanical connection region 10" may extend past the straight line D, or on the contrary end short of it. Thus, in FIG. 2A, the free ends $E'_1$ and $E'_2$ of the two fingers $\mathbf{10}_1$ and $\mathbf{10}_2$ extend past the straight line D, that is towards the tip of the racquet. The angle $\beta_1$ formed by the abovementioned straight line D and the straight line $D_1$ connecting the centre C and the end $E'_1$ thus has a value of as much as +30°.

On the other hand, in FIG. 2B, the ends $E''_1$ and $E''_2$ are situated between the handle 2 and the straight line D. In this situation the angle $\beta_2$ formed by this straight line D and the straight line $D_2$ connecting the centre C and the end $E''_2$ may be as much as −60°. By definition, in these FIGS. 2A and 2B, the value of the angle β is negative when the free ends of the fingers are towards the handle, and positive when they are placed towards the tip of the racquet.

Referring again to FIG. 2, α is the angular sector occupied by the mechanical connection region 10". This sector is defined by the free end $E_1$ and $E_2$ of each finger which is located on the transverse straight line D in this FIG. 2, and by the straight line D' connecting the centre C and the point of transition T between the free region 10' and the mechanical connection region 10". In this situation, α is advantageously between 10 and 90°, preferably between 30 and 60°.

To manufacture the frame described above, a preform comprising the handle 2, the arms 6 and most of the rim 4 is first made in the usual way. This assembly is then placed in a mould and a bridge 12 is inserted, so as to form the complete rim, in accordance with a routine operation. Lastly, the racquet is moulded finally by blow moulding.

Figure 4:
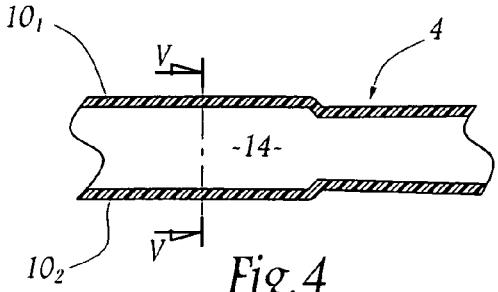
FIG. 4 is a cross section on the plane marked IV-IV in FIG. 3.
Figure 5:
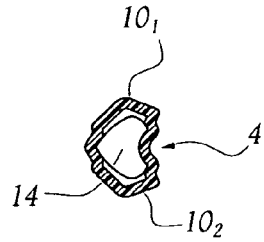
FIG. 5 is a cross section on the plane marked V-V in FIG. 4.

FIG. 4 is a longitudinal cross section through the racquet, taken in the region of the free end of the fingers $\mathbf{10}_1$ and $\mathbf{10}_2$. As this figure shows, a single tube 14 forms the fingers $\mathbf{10}_1$ and $\mathbf{10}_2$ of each arm, and the rim 4. This is also shown in FIG. 5, which is a transverse cross section through the rim and through the two fingers $\mathbf{10}_1$ and $\mathbf{10}_2$ situated on either side of the latter.

It will be seen that in this first illustrative embodiment, certain parts of the racquet frame may be made of one material, while other parts of the frame are made of a different material. For example, the material of the rim 4 may differ from the material both of the handle 2 and of the arms 6.

Figure 7:
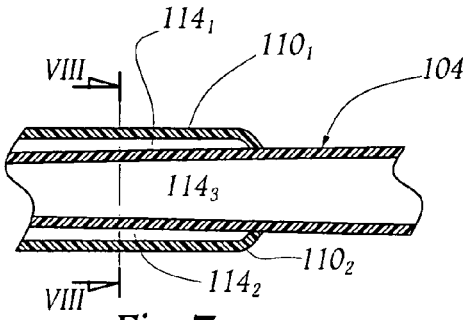
FIGS. 7 and 8 are a longitudinal cross section and transverse cross section, respectively, similar to FIGS. 4 and 5, showing the racquet frame in this first variant.
Figure 8:
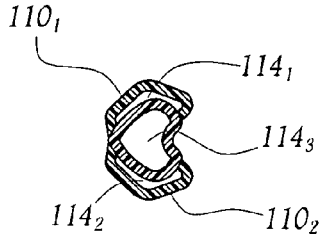
Figure 6:
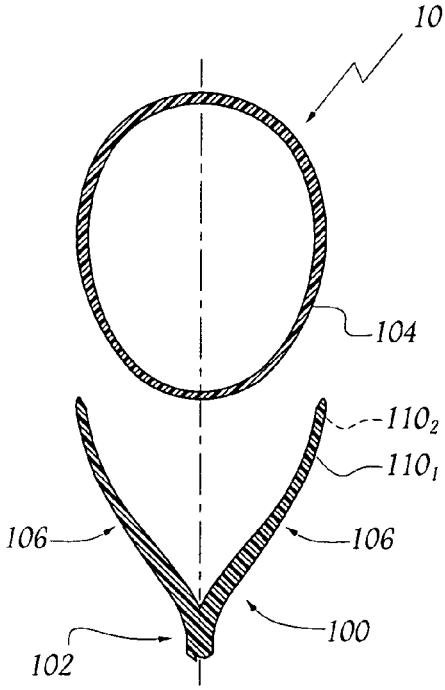
FIG. 6 is a front view showing in schematic form a step of manufacturing a tennis racquet frame in a first variant of the invention.

FIGS. 6 to 8 show a first variant of the invention. Here, two preforms are made, both using the same mouldable material, or two compatible mouldable materials. The first of these preforms 100, which is Y-shaped, includes the handle 102 as well as the two arms 106, each of which comprises two fingers $\mathbf{110}_1$ and $\mathbf{110}_2$, as before. Furthermore, the second 101 of these preforms will form a rim 104.

Once these preforms are made, by any appropriate conventional technique, they are placed in a single mould and joined together for example by putting into the mould, before the blow-moulding operation, preimpregnated carbon fingers or "tapes" along the mechanical join region. The differences between this second embodiment and that described with reference to FIGS. 1 to 5 are more particularly highlighted in FIGS. 7 and 8, which are cross sections similar to those of FIGS. 4 and 5.

These figures thus show that the rim 104 and the fingers $\mathbf{110}_1$ and $\mathbf{110}_2$ of each arm 106 are not formed by a single tube, as in the first embodiment. Instead, two tubes $\mathbf{114}_1$ and $\mathbf{114}_2$ belonging to the first preform 100, may be seen to define the two fingers $\mathbf{110}_1$ and $\mathbf{110}_2$. There is also a central tube $\mathbf{114}_3$, belonging to the second preform 101, which defines the rim 104.

This second embodiment has advantages in terms of modularity since it makes it possible to produce very conveniently a racquet frame formed of different materials and thus makes it possible easily to modify the mechanical behaviour of the racquet.

Figure 9:
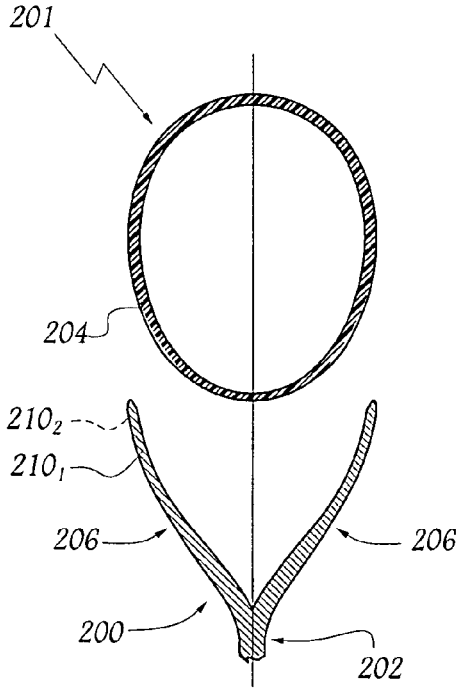
FIG. 9 is a schematic view, similar to FIG. 6, of another variant of the invention.

FIG. 9 shows a third embodiment of the invention, in which two elements 200 and 201 which are to form the final racquet frame may be seen. However, unlike the preforms 100 and 101, the elements 200 and 201 are "final", in the sense that they will not go through a subsequent moulding operation.

The first element 200, similar in its geometry to the preform 100, combines the handle 202 and the two arms 206, each of which is formed of two fingers $\mathbf{210}_1$ and $\mathbf{210}_2$. The second element 201, which is similar in its geometry to the preform 101, also forms the rim 204. To make the final frame, the element 201 is attached to the element 200 by any appropriate fixing means.

First and foremost this may be a permanent fixing. A non-restrictive example that may be cited is adhesively bonding or welding together these two elements 200 or 201.

Alternatively the element 201 may be fixed removably to the element 200. For this purpose it may for example be snap-fastened or screw-fastened.

The embodiment illustrated with reference to FIG. 9 has the particular advantage of allowing the use of elements made from different materials. Thus, the Y-shaped element 200 can be made of a composite material, while the element 201 is then made of another composite material, or of a metal. The element 200 may however be made of a metallic material, while the element 201 is in this case made of another metallic material or a composite material.

The invention claimed is:

1. A tennis racquet frame comprising a handle, a rim and a pair of outwardly diverging arms connecting the handle and the rim, wherein each arm includes two fingers that are spaced from one another with one finger extending above and engaging a first side of the rim and one finger extending below and engaging an opposite side of the rim when the racquet frame is laid flat so as to be generally parallel with a support surface.

2. The tennis racquet frame according to claim 1, wherein each arm includes a base continuing on from the handle, from which the two fingers extend.

3. The tennis racquet frame according to claim 1, wherein the two fingers define a first region in which a void is created therebetween and wherein they are spaced from the rim, and a second region of mechanical connection to the rim.

4. The tennis racquet frame according to claim 3, wherein a free end of the mechanical connection region of each finger defines a straight line forming, with a central transverse straight line of the rim, an angle (β) of between −60° and +30°.

5. The tennis racquet frame according to claim 3, wherein the mechanical connection region occupies an angular sector (α) of between 10 and 90°.

6. The tennis racquet frame of claim 5 wherein the angular sector (α) is between 30 and 60°.

7. The tennis racquet frame according to claim 1, wherein the two fingers of each arm are integrally molded with the rim.

8. The tennis racquet frame according to claim 7, wherein the two fingers and the rim are formed by a single tubular member.

9. The tennis racquet frame according to claim 7, wherein the two fingers are formed from a first tubular member, while the rim is made from a second tubular member.

10. The tennis racquet frame according to claim 9, wherein the handle and the two arms are preformed together as one preform, and the rim is preformed as another preform and wherein the two preforms are molded together.

11. The tennis racquet frame according to claim 1, wherein the rim is fixed permanently to the two fingers of each arm by welding or adhesive bonding.

12. The tennis racquet frame according to claim 11, wherein the handle of the tennis racquet and the arms are formed as one element, and the rim is formed as another element, and the two elements are secured to each other.

13. The tennis racquet frame according to claim 1, wherein the two fingers of each arm are removably secured to the rim.

14. The tennis racquet frame according to claim 1, wherein the handle, arms and rim are made of one material.

15. The tennis racquet frame according to claim 14, wherein the material is a carbon-based composite material.

16. The tennis racquet frame according to claim 1, wherein the handle and the two arms are made of one material, and the rim is made of another material.

17. A tennis racquet including a frame according to claim 1.

* * * * *